US006189697B1

(12) United States Patent
Davis

(10) Patent No.: US 6,189,697 B1
(45) Date of Patent: Feb. 20, 2001

(54) COSMETIC CONTAINER

(76) Inventor: Sylvia Davis, 1205 C Lake Shore Dr., Columbus, OH (US) 43202

( * ) Notice: Under 35 U.S.C. 154(b), the term of this patent shall be extended for 0 days.

(21) Appl. No.: 09/359,378

(22) Filed: Jul. 23, 1999

(51) Int. Cl.[7] ..... B65D 69/00

(52) U.S. Cl. ..... 206/581; 206/373; 383/38; 383/39; 220/495.01

(58) Field of Search ..... 206/581, 372, 206/373, 349, 376, 377; 383/39, 40; 220/735, 495.01, 495.03, 23.91, 495.11

(56) References Cited

U.S. PATENT DOCUMENTS 4,765,472 * 8/1988 Dent ..... 206/373
4,977,941 * 12/1990 Henderson ..... 150/112
4,993,551 * 2/1991 Lindsay ..... 206/373
5,002,401 * 3/1991 Blackman ..... 383/38
5,117,724 * 6/1992 Gardner ..... 206/314
5,174,447 * 12/1992 Fleming ..... 206/373
5,186,329 * 2/1993 Fogelberg ..... 206/372
5,429,265 * 7/1995 Maire et al. ..... 220/522
5,653,337 * 8/1997 Cirigliano ..... 206/373
5,848,701 * 12/1998 Riccabona ..... 206/702

* cited by examiner

*Primary Examiner*—Paul T. Sewell
*Assistant Examiner*—Shian Luong
(74) *Attorney, Agent, or Firm*—Vorys, Sater, Seymour and Pease LLP

(57) ABSTRACT

A container for personal articles such as cosmetics and the like has a rigid shell and a flexible cover that fits over the shell. The cover has a central pocket with one or more pockets arranged around the inside of the wall of the central pocket and an exterior wall having one or more pockets arranged around the exterior wall. The cover is removably fastened to the shell, preferably by means of a skirt having fasteners thereon which is folded under the base of the shell and secured by the fasteners to hold the cover in position about the shell.

6 Claims, 4 Drawing Sheets

COSMETIC CONTAINER

BACKGROUND OF THE INVENTION

1. Field of the Invention

This invention relates to storage containers for cosmetic materials and utensils and more particularly to storage containers for cosmetics having multiple pockets for sorting and storing cosmetics and personal articles.

2. Brief Description of the Prior Art

Holders for organized storage of tools and equipment for ready access have been devised for the convenience of craftsmen. A number of such tool holders have been designed in the form of attachments to be mounted on a bucket or the like for convenient transportation.

U.S. Pat. No. 4,993,551, to Lindsay, discloses a tool holder and storage device comprising a tubular cloth panel that drapes and conforms over the inside and outside surfaces of a bucket, with pockets sewn onto the inner and outer flaps of the panel.

U.S. Pat. No. 4,765,472, to Dent, discloses a tool holder comprising a cloth panel arranged to surround a bucket, having pockets sewn to the outside of the panel, and provided with snap hooks for suspending the tool holder from the handle of the bucket.

U.S. Pat. No. 5,174,447, to Fleming, discloses a tool holder to be supported on a bucket, the tool holder having an interior leaf and an exterior leaf, both leaves being provided with pockets for holding tools and the like.

U.S. Design Pat. Nos. 388,919 and 396,912, both to Maire, and U.S. Design Pat. No. 345,237, to Stein, show tool carriers containing pouches for holding tools and articles designed to be draped over a bucket.

Such tool carriers are generally held in place on the bucket or the like by the weight of the tools contained in their pockets or pouches and do not require separate fastening elements to secure them on the supporting structure.

U.S. Pat. No. 5,117,724, to Gardner, discloses a container for holding drumsticks comprising a cloth cover for a drummer's stool having a depending skirt with pockets sewn onto the outside of the skirt.

A number of containers have also been devised for holding cosmetics, toilet articles, and game articles for convenient transportation and use.

U.S. Pat. No. 5,002,401, to Blackman, discloses a foldable container comprising a dual layer of cloth with panels of stiffening and/or shock absorbing material positioned between the layers and pockets sewn onto one of the cloth layers. The container is designed to fold up with the pockets on the inside and is provided with a drawstring and/or hook and loop fastener to hold the container in a closed configuration.

U.S. Pat. No. 4,880,315, to Berry et al., discloses a roll-up carrying case for cosmetic articles and the like comprised of a cloth panel having one or more pockets sewn to the panel and extending the entire length of the panel. Holes are provided at intervals along the panel for inserting clips to divide the single pocket into two or more separate pockets for holding articles.

U.S. Pat. No. 1,125,396, to Rabinowitz, discloses a holder and carrier for toilet articles having a flexible band that can be formed into a circular, self-supporting shape with pockets on both sides thereof for holding toilet articles.

U.S. Pat. No. 4,977,941, to Henderson, discloses a bingo bag, made of quilted material to be self-supporting, provided with interior pockets for holding implements useful in playing bingo and a drawstring closure at the top.

However, the containers described in the prior art do not provide a self-supporting unit that has pockets for conveniently holding personal articles such as cosmetics and the like on a vanity table or bathroom counter. Accordingly, a need has continued to exist for such a self-supporting container for cosmetic articles and the like.

SUMMARY OF THE INVENTION

The need has now been met by the cosmetic container of the invention which has a hollow rigid shell having an upstanding wall at least partially surrounding a central cavity, and a flexible cover adapted to fit over the shell and be removably fastened to the shell or around the shell. The cover is made of a flexible material, e.g., cloth, and has a central pocket fitting within the cavity of the shell and an exterior panel surrounding the wall of the shell. The cover is removably fastened to the shell by adhesive or by conventional fasteners, such as hook and loop fasteners, or is provided with flaps or a skirt, or the like, which may be folded under the shell and fastened together, to the shell, or to the central pocket with a removable fastener.

Accordingly, it is an object of the invention to provide a container for cosmetic articles and the like.

A further object is to provide a container having a supporting shell and removable cover therefor.

A further object is to provide a container having a supporting shell and a cover for inside and outside surfaces of the shell forming a central pocket located within the shell and peripheral pockets located on the wall of the central pocket and/or on the part of the cover surrounding the shell.

A further object is to provide a container having a rigid shell and a flexible cloth cover that can be removed for cleaning and the like.

A further object is to provide a container having a rigid shell and a flexible cloth cover held in position around the shell by fasteners, e.g., hook and loop fasteners.

Further objects of the invention will become apparent from the description of the invention which follows.

DETAILED DESCRIPTION OF THE INVENTION AND PREFERRED EMBODIMENTS

Figure 1:
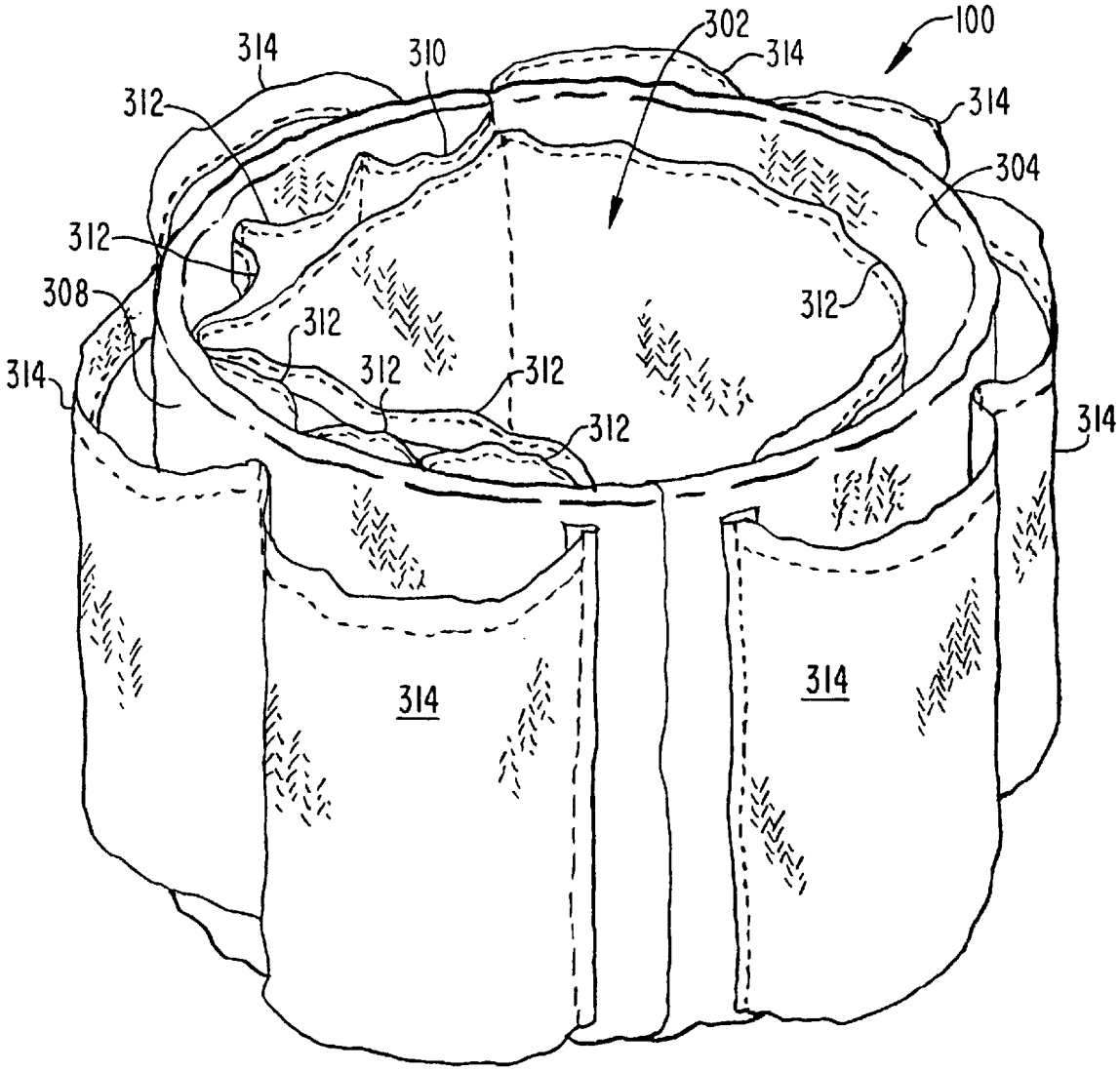
FIG. 1 is a perspective view of an embodiment of the container of the invention as assembled.

The cosmetic container of the invention is designed to hold personal articles such as cosmetics, applicators, shaving supplies, and the like, conveniently on a vanity table or bathroom counter. It provides a place wherein such personal articles can be placed to prevent cluttering the table or counter surface and misplacing the articles.

The container is provided with a rigid shell that gives internal support and shape to the container. The shell is a hollow, generally cylindrical or prismatic structure made of a rigid material such as plastic, metal, or the like. The shell includes an upstanding wall that determines the general shape of the container. In a preferred embodiment the circumference of the shell wall has a circular shape, i.e., a circular horizontal cross-section. However, the shell wall may alternatively have a polygonal, e.g., hexagonal, or elliptical horizontal cross-section. The shell wall need not be a completely closed structure, but the shell must have a wall that extends over a sufficient portion of the circumference of the container to provide support for the flexible cover with attached pockets. The shell may be formed by the wall alone. However, preferably the shell has a base or bottom that supports the wall. The base or bottom may be flat or downwardly concave so that it will rest on its bottom surface or the rim or periphery thereof. The wall is attached at its lower edge to the periphery of the base of the shell and extends upward to support the cover with its upper edge. The wall need not be continuous, but should extend over enough of the periphery of the base to provide sufficient support and rigidity for the cover to hold and contain the articles it is intended to store. The wall of the shell need not be exactly vertical, but it is preferable that the wall should not deviate from the vertical to the extent that the container will be distorted. Accordingly, it is preferred that the wall of the shell should be approximately vertical.

The shell may be made of any material that provides sufficient rigidity to provide firm support for the cover. Accordingly, the shell may be made of metal, plastic, ceramic, wood, or the like. It may be made of continuous sheet of material, optionally perforated to reduce its weight, or it may be woven as a basket or the like.

The cover is formed from a flexible material such as woven cloth, plastic sheet material, nonwoven web, or the like. It is preferred to make the cover from a cloth web that may be dyed, printed, trimmed, or otherwise decorated to provide a decorative and pleasing appearance to the container.

The cover is shaped to fit over the wall of the shell. It has a central pocket with a closed bottom and a sidewall generally conforming to the interior of the wall of the shell. An exterior panel covers the outside of the shell. The central pocket is closed at the bottom and may extend to the bottom of the shell or to a lesser depth within the shell. One or more peripheral pockets are preferably formed on the inside of the sidewall of the central pocket. These peripheral pockets may be of various sizes as needed to accommodate the various cosmetic articles and supplies intended to be contained therein. The peripheral pockets may be attached to the sidewall of the central pocket by any conventional means, such as sewing, adhesive, hook and loop fasteners, or the like. It is preferred that the cover be formed of woven cloth, and that the pockets be attached thereto by sewing.

The exterior panel of the cover may be made of any of the materials usable for the sidewall and bottom of the central pocket. It may be made of the same material as the central pocket or of a different material. Preferably the exterior panel will be made of the same material as the central pocket. The exterior panel is also provided with one or more peripheral pockets, of a size appropriate for containing personal and cosmetic articles. These peripheral pockets are attached to the exterior panel by any conventional procedure as discussed above for the peripheral pockets of the central pocket. Preferably the exterior panel is made of cloth and the pockets are attached thereto by sewing.

The cover is removably secured to the shell or about the shell, in order to hold the cover securely in place, yet permit it to be removed for cleaning or to substitute a different cover. Accordingly, the cover is provided with a fastening element generally attached to the lower edge of the exterior panel.

The fastening element may comprise a pressure sensitive adhesive applied to the one or both of the exterior panel or the shell wall at a location generally adjacent to the bottom of the shell. The fastening element may also be a conventional snap fastener or hook and loop fastener, with mating parts of the fastener mounted on the shell and the exterior panel of the cover generally adjacent to the bottom of the shell.

The fastening element may also be a flexible flap of cloth or the like attached to the lower edge of the exterior panel and extending below the lower edge of the panel so as to be adapted to be folded under the shell. The flap may be provided with an adhesive area or fasteners as discussed above to fasten the flap to the base or bottom of the shell, if the shell has a closed base, or to the bottom of the central pocket if the bottom of the shell is open. The fastening element may also be a pair of flaps that fold under the shell and are provided with adhesive areas or fasteners to secure the flaps to one another. In a preferred embodiment the fastening element is a flexible skirt, extending downward from the lower edge of the exterior panel, that can be folded under the shell. The skirt is provided with adhesive areas, snap fasteners, hook and loop fasteners, or the like, to fasten opposite portions of the skirt together when the skirt is folded under the shell. Preferably, the skirt is provided with hook and loop fasteners (Velcro®).

The bottom of the central pocket and the inside of the base of the shell (or the skirt if the bottom of the shell is open) may also be provided with complementary fasteners, e.g., hook and loop fasteners, in order to secure the central pocket to the base of the shell or to the folded skirt.

A preferred embodiment of the invention is illustrated in the accompanying drawings, wherein the reference numerals refer to the same elements in each figure.

Figure 2:
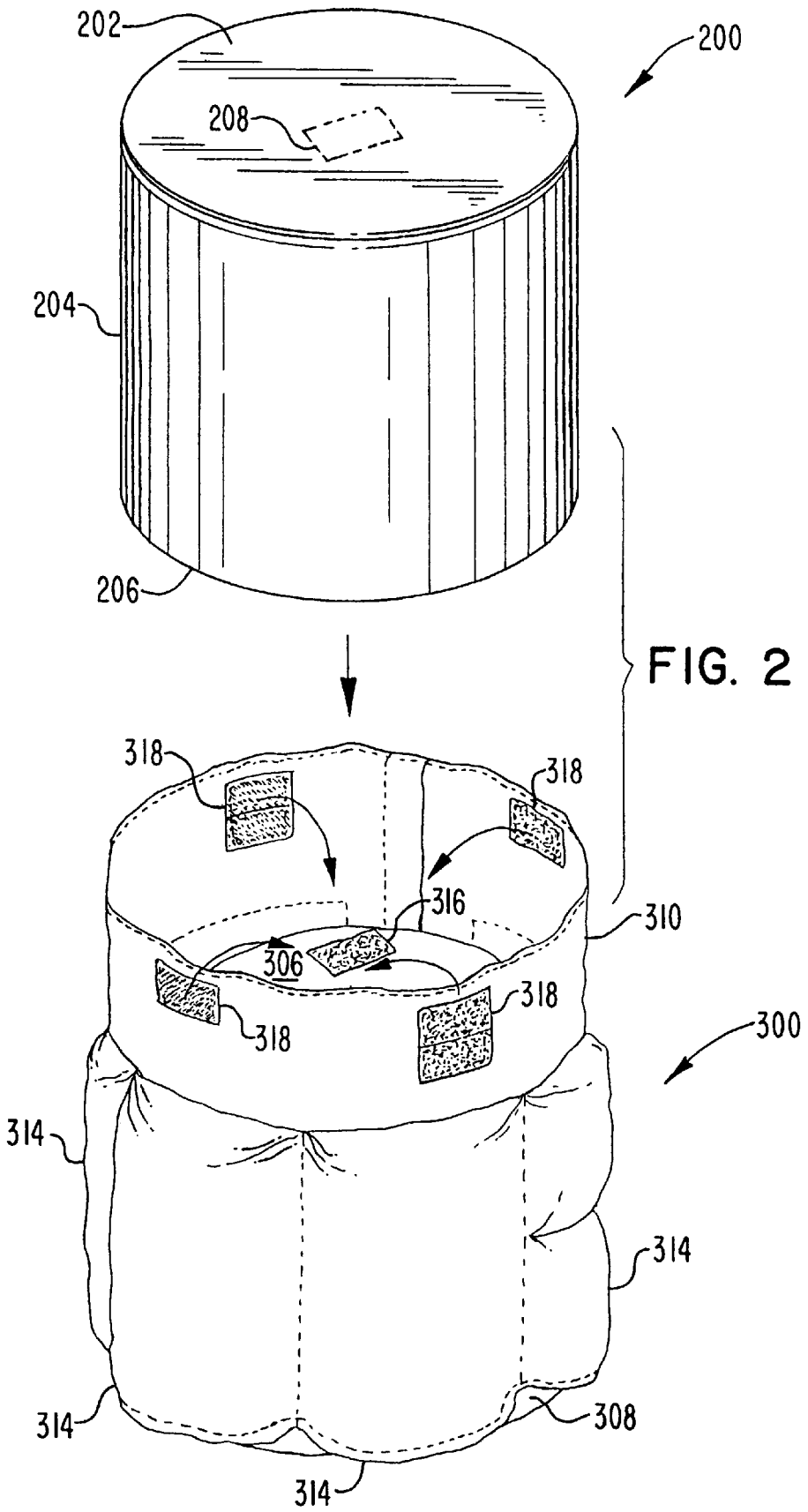
FIG. 2 is an exploded view showing the shell and the cover of the embodiment of FIG. 1 in inverted position for convenient assembly.

The illustrated cosmetic container 100 of the invention comprises a shell 200, best seen in FIG. 2, and a cover 300 designed to fit over the shell 200. The shell 200, in the illustrated embodiment, has a bottom or base 202 and generally cylindrical wall 204 having a rim 206. The wall 204 is preferably of circular cross section, as shown. However it is not excluded that the wall 204 may have other cross-sections, such as elliptical, polygonal, e.g., hexagonal, or the like.

The cover 300 is comprised of a central or interior pocket 302 having a sidewall 304 which is sewn in a generally cylindrical form with a closed bottom 306. An exterior panel 308 of the cover 300 surrounds the wall 204 of the shell 200. The exterior panel 308 is generally of a height to match the height of the wall 204 of the shell 200. A skirt 310 depends from the bottom of the exterior panel 308. One or more interior peripheral pockets 312 may be sewn or otherwise fastened to the sidewall 304 of the central pocket 302, and one or more exterior peripheral pockets 314 may be arranged around the exterior panel 308 of the cover 300. The number and arrangement of the interior pockets 312 and exterior pockets 314 may be varied as convenient to provide a useful container for cosmetic articles and the like.

Figure 3:
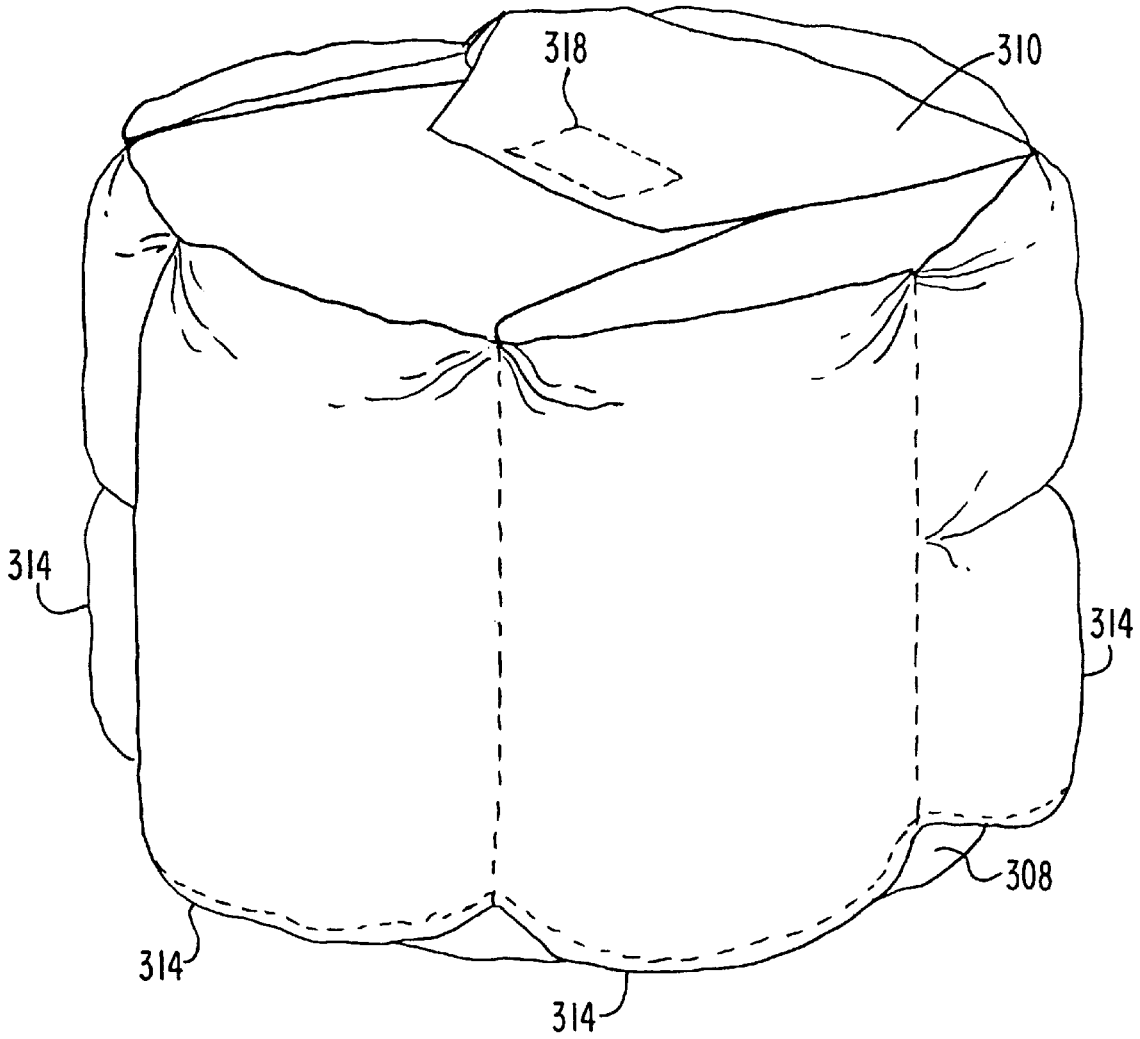
FIG. 3 shows the assembled container and shell of the embodiment of FIGS. 1 and 2 in inverted position with the skirt of the cover secured over the bottom of the shell.

In order to secure the cover 300 about the shell 200, the skirt 310 is provided with fasteners 318 that mate with one another when the skirt is folded under the bottom 202 of the shell 300. Preferably, the fasteners 318 are of the hook and loop type (Velcro®), sewn to the skirt 310 in mating pairs generally opposite one another. Two pairs of fasteners are illustrated, but more or fewer pairs can be used. The opposite members of a pair will mate when the opposite portions of the skirt 310 are folded over the bottom 202 of the shell 200, as shown in FIG. 3. If desired, a fastener 316 may be fixed to the bottom 306 of pocket 302. A complementary fastener 208 is mounted on the inside of the bottom 202 of the shell 200 in order to fasten the bottom 306 of the pocket 302 to the bottom 202 of the shell 200.

The manner of assembling the container 100 of the invention is illustrated in FIGS. 2 and 3. The cover 300 is fitted over the shell 200 and the skirt 310 of the cover 300 is folded over the bottom 202 of the shell 200 so that the fasteners 318 meet and secure the cover 300 about the shell 200. The assembled container is shown in inverted position in FIG. 3. FIG. 1 shows the container in upright position ready for use.

Figure 4:
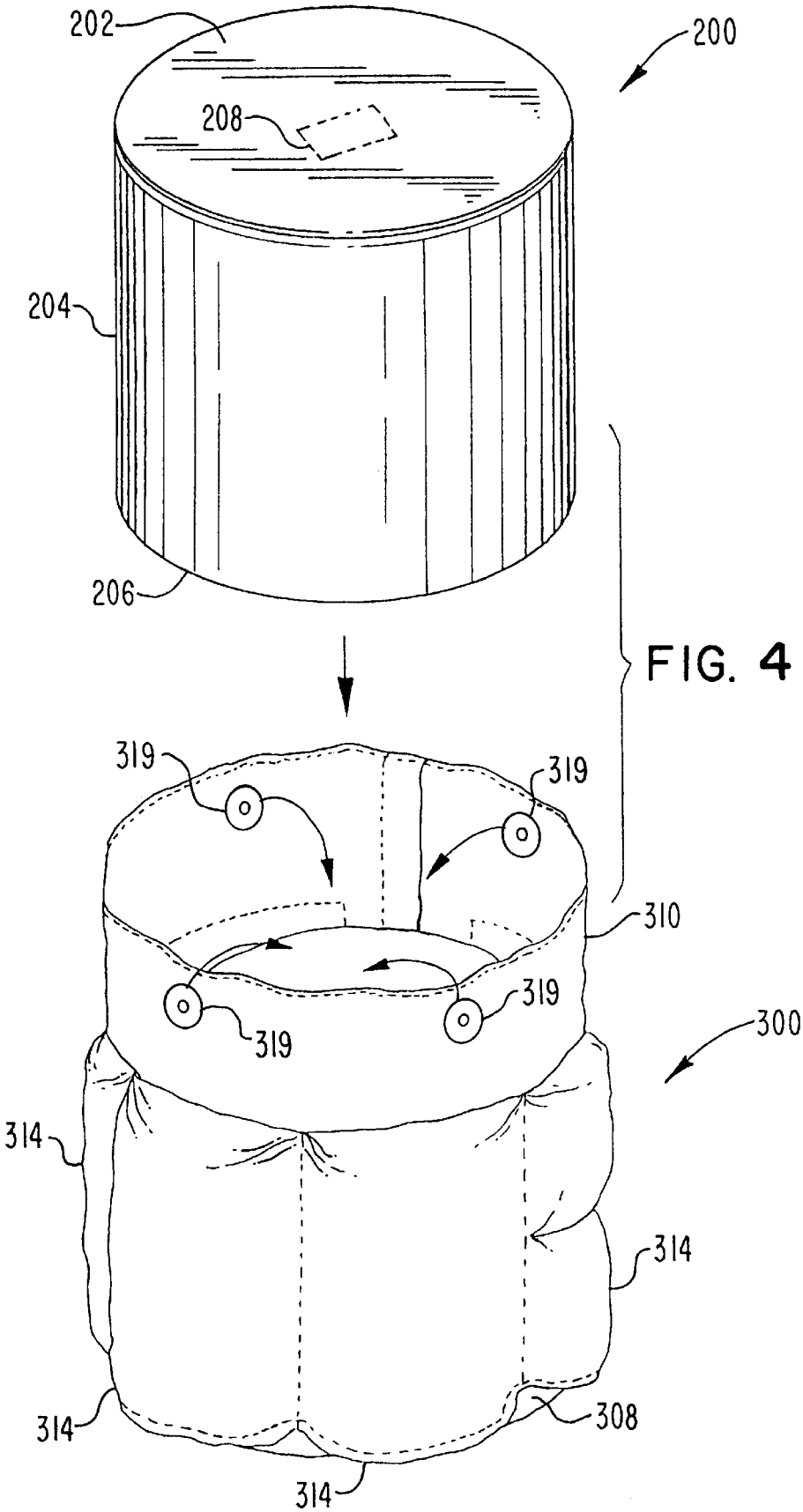
FIG. 4 shows an alternate embodiment of the cosmetic container of the invention which uses snap fasteners to secure the cover in position around the shell.

FIG. 4 shows an alternate embodiment of the cosmetic container 100 of the invention having snap fasteners 319 which secure the cover 300 in position around the shell 200.

The invention having now been fully described, it should be understood that it may be embodied in other specific forms or variations without departing from its spirit or essential characteristics. Accordingly, the embodiments described above are to be considered in all respects as illustrative and not restrictive, the scope of the invention being indicated by the appended claims rather than the foregoing description, and all changes which come within the meaning and range of equivalency of the claims are intended to be embraced therein.

I claim:

1. A cosmetic container comprising:

a hollow rigid shell having a base portion and a wall extending perpendicularly from the base portion, said wall having an upper edge defining an opening in the shell and a lower edge joining the base portion a flexible cover adapted to fit over said shell, said cover comprising a central pocket fitting inside the hollow portion of said shell, an exterior panel surrounding the wall of said shell and extending around the lower edge of the wall so that it covers at least a portion of said base, and a fastening element binding together at least portions of the exterior panel covering said base.

2. The cosmetic container of claim 1 wherein the exterior panel comprises a skirt covering at least a portion of said base, at least one part of the skirt having a snap fastener which is adapted to cooperate with a complementary snap fastener located on another part of said skirt.

3. The cosmetic container of claim 2 wherein said fastening element comprises at least one hook and loop fastener wherein said hook element is on one part of said skirt and adapted to cooperate with a complementary loop element on a substantially opposite portion of said skirt.

4. The cosmetic container of claim 1 additionally comprising at least one interior peripheral pocket attached to said central pocket.

5. The cosmetic container of claim 1 additionally comprising at least one exterior peripheral pocket attached to said exterior panel.

6. A container for personal articles comprising a hollow rigid shell having a base and an upstanding wall, said wall having an upper edge and a lower edge attached to said base, said wall surrounding a central cavity, and a flexible cover adapted to fit over said shell, said cover comprising a central pocket fitting within said cavity of said hollow shell, an exterior panel surrounding said wall of said shell, said exterior panel having a lower edge adjacent said lower edge of said wall of said shell, and a skirt extending downward from said lower edge of said exterior panel, said skirt being provided with at least one hook and loop fastener adapted to cooperate with a complementary hook and loop fastener when said skirt is folded under said base of said shell to secure said cover on said shell.

* * * * *